US005901467A

United States Patent [19]

Peterson et al.

[11] Patent Number: 5,901,467

[45] Date of Patent: May 11, 1999

[54] SHOE CONSTRUCTION INCLUDING PNEUMATIC SHOCK ATTENUATION MEMBERS

[75] Inventors: William Peterson, Granada Hills; Robert O. Dillon, Irvine, both of Calif.

[73] Assignee: American Sporting Goods Corporation, Irvine, Calif.

[21] Appl. No.: 08/988,825

[22] Filed: Dec. 11, 1997

[51] Int. Cl.[6] ..... A43B 13/18; A43B 13/20; A43B 13/40

[52] U.S. Cl. ..... 36/29; 36/35 B; 36/28; 36/37; 36/92

[58] Field of Search ..... 36/28, 29, 35 B, 36/35 R, 37, 92

[56] References Cited

U.S. PATENT DOCUMENTS

| | | | |
|---|---|---|---|
| 836,364 | 11/1906 | Busby | 36/29 |
| 1,240,153 | 9/1917 | Olsen | 36/35 R |
| 2,724,914 | 11/1955 | Wick | 36/35 R |
| 4,265,033 | 5/1981 | Pols | 36/37 |
| 4,768,295 | 9/1988 | Ito | 36/28 |
| 4,779,359 | 10/1988 | Famolore, Jr. | 36/29 |
| 5,179,792 | 1/1993 | Brantingham | 36/29 |
| 5,353,459 | 10/1994 | Potter et al. | 36/29 |
| 5,363,570 | 11/1994 | Allen et al. | 36/28 |
| 5,375,346 | 12/1994 | Cole et al. | 36/29 |
| 5,443,529 | 8/1995 | Phillips | 36/29 |
| 5,685,090 | 11/1997 | Tawney et al. | 36/29 |
| 5,718,063 | 2/1998 | Yamashita et al. | 36/28 |

*Primary Examiner*—Paul T. Sewell
*Assistant Examiner*—Anthony Stashick
*Attorney, Agent, or Firm*—Michael A. Painter

[57] ABSTRACT

The construction of a shoe which includes shock attenuating members in the forefoot and heel thereof. The shock attenuating members in the heel of the shoe are in the form of a pair of vertically spaced, resilient cantilevered members, each of which comprises a substantially U-shaped air chamber having a load alignment surface for centering loads at heal strike while concurrently transferring peak loads to the outer perimeter of the cantilevered shock attenuating members. The forefoot shock attenuating member comprises a plurality of segmented air chambers in a planar relationship with each other disposed between the midsole and outsole at the forefoot thereof to properly balance and stabilize loads during running and concurrently maximize durability, cushioning and comfort.

8 Claims, 2 Drawing Sheets

FIG. 1.
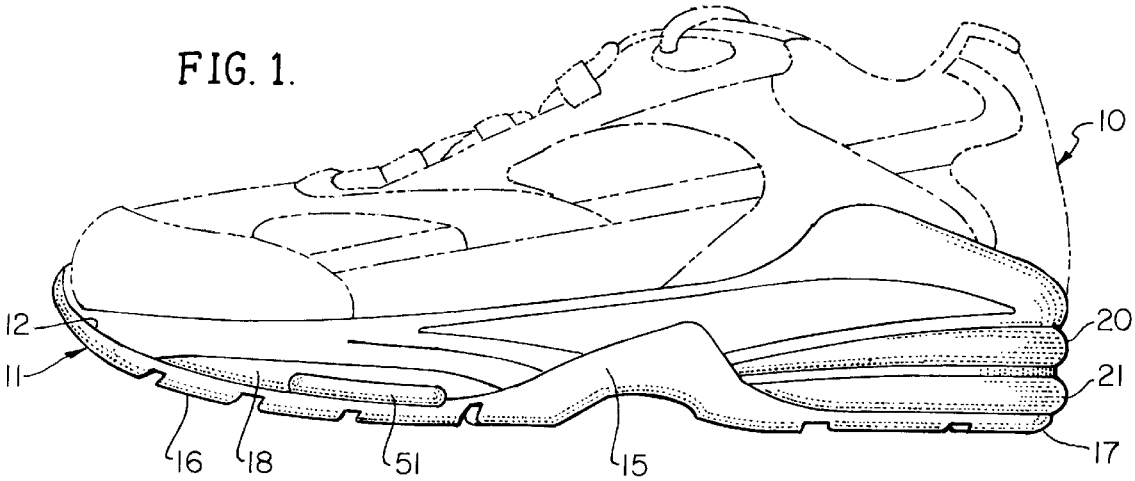
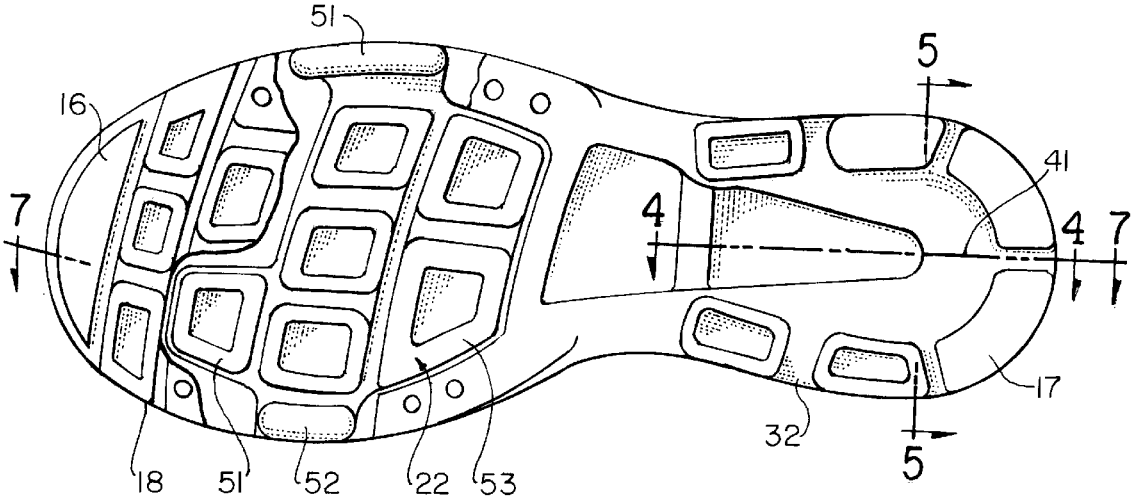
FIG. 2.
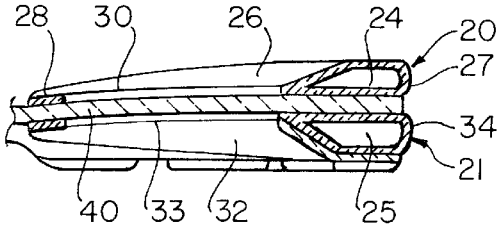
FIG. 4.
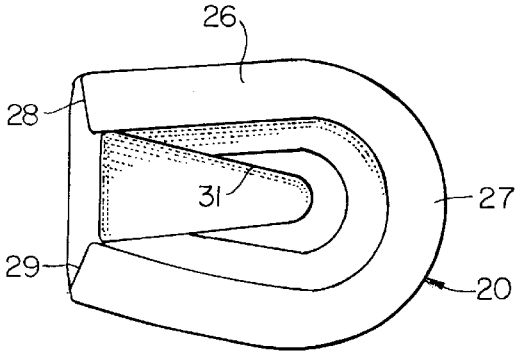
FIG. 3.

SHOE CONSTRUCTION INCLUDING PNEUMATIC SHOCK ATTENUATION MEMBERS

BACKGROUND OF THE INVENTION

1. Field of the Invention

The present invention generally relates to footwear and, more particularly to footwear having shock attenuating members incorporated at the heel and forefoot thereof.

2. Prior Art

During the conduct of athletic activities such as running, basketball and tennis, substantial shock forces are imposed upon the user's foot. The shock forces are transmitted through the user's shoes to the user's foot each time the shoe comes in contact with the ground or surface over which the surface moves. Over time, the shock imposed upon the user can result in discomfort, fatigue and possible injury.

The terms "shock attenuation" and "energy absorption" are often used without delineating the difference. While both effects relate to the independent responses of a midsole's response to the force of impact, the term "impact response" more properly describes the response of a midsole to both effects. A desirable midsole, therefore, is one in which the impact response contains the appropriate balance of shock attenuation and energy absorption.

The prior art discloses a variety of shoe designs which employ cushioned soles to absorb at least a portion of the shock and thereby alleviate the problems. However, it has long been understood that the employment of cushioned soles must be as part of a structural environment which avoids destabilizing the user's foot while maintaining a firm platform for the user.

To attenuate force resulting from heel and forefoot contact, shoes were designed which focused attention upon cushioning. To this end, some designs disclosed by the prior art merely increase the thickness of the midsole. Other designs incorporate cushioning elements intended to provide enhanced cushioning effects. As an example, resilient, inflated bladders were used as midsole inserts. These designs do not resolve the major problem resulting from the shock produced by heel contact. The present invention resolves these problems through the use of cantilevered, shock attenuating members mounted at the heels of the shoe.

One of the shoe designs disclosed by the prior art employs replaceable, compressible shock absorbers at the heel and forefoot of the shoe. In this construction, the compressible members are replaceable. As a result, the shock absorbing members do not extend fully across the heel or forefoot. To the contrary, the shock absorbing members are disposed within receiving, aligned apertures in the midsole and outsole. The disadvantages of this design are the result of its inability to fully respond to the shock of heel and forefoot contact. The present invention resolves these problems by providing for cantilevered, shock attenuating members mounted across the full extent of the heel. The cantilevered members include opposing load alignment surfaces which stabilize the shoe by centering the load on heel contact and transferring peak loads to the periphery thereof.

Other designs disclosed by the prior art disclose compressible shock absorbing members at both the heel and forefoot of the shoe. However, the shoe constructions disclosed by the prior art exhibit substantially uniform impact response across the entire width of the heel and forefoot. This results in improper balance and stabilization of the force imposed on the shoe. This inadequacy is resolved by the present invention shoe construction.

The present invention substantially resolves the problems inherent in those designs disclosed in the prior art. The present invention employs shock attenuating members disposed at both the heel and forefoot of the shoe. The shock attenuating members disposed in the heel comprise a pair of cantilevered air chambers which are vertically secured with relationship to each other. The upper air chamber includes a load alignment surface aligned along the longitudinal axis of the heel. The lower shock attenuating member employs an equivalent load alignment surface in opposed relationship to that of the upper shock attenuating member. The impact response of the two cantilevered attenuating members centers the shock associated with heel contact while distributing or otherwise transferring peak loads along the periphery thereof.

SUMMARY OF THE INVENTION

The present invention comprises a shoe design which employs shock attenuating members at the heel and forefoot of the shoe. The shock attenuating member at the heel of the shoe consists of a pair of air chambers which are vertically separated by a foam moderator of predetermined density. Each heel shock attenuating member comprises a resilient, non-permeable chamber adapted to fully enclose a selected fluid such as air. Each air chamber is a substantially U-shaped configuration being centrally tapered downwardly from the base of the "U" to the frontal legs or margins thereof. Each of the heel shock attenuating members includes a load alignment depression uniformly centered about the chambers longitudinal axis. The heel shock attenuating members are vertically secured on either side of the foam moderator, the load alignment depression of each chamber being opposed with respect to the other. The assembled heel shock attenuating members are mounted at the heel of the shoe and when heel contact occurs at the rear strike zone, the frontal margins cantilever about the rearmost portion of the heel. The resulting structure results in the centering of impact loads upon heel contact and distributes peak loads along the periphery of the coupled shock attenuating members.

The forefoot shock attenuating member comprises a plurality of air chambers extending longitudinally along the forefoot of the shoe to maximize cushioning and stability when forces is being imposed upon the forefoot of the shoe. The combination of the heel and forefoot shock attenuating members improve shock and energy absorption and the response thereto.

It is therefore an object of the present invention to provide an improved construction for a shoe through the employment of heel and forefoot shock attenuating chambers.

It is another object of the present invention to provide a shoe construction which improves impact response to heel contact through the use of vertically oriented cantilevered pneumatic chambers.

It is still another object of the present invention to provide a shoe construction which, upon heel contact, results in distribution of loads along the periphery of the heel shock attenuating members.

It is still yet another object of the present invention to provide an improved shoe construction which is simple and inexpensive to fabricate.

The novel features which are believed to be characteristic of the invention, both as to its organization and method of operation, together with further objectives and advantages thereof, will be better understood from the following description considered in connection with the accompanying drawing in which a presently preferred embodiment of the invention is illustrated by way of example. It is to be expressly understood, however, that the drawing is for the purpose of illustration and description only, and is not intended as a definition of the limits of the invention.

BRIEF DESCRIPTION OF THE DRAWINGS

FIG. 1 is a side elevation view of a shoe employing the present invention shoe construction.

FIG. 2 is a bottom plan view of the shoe shown in FIG. 1.

FIG. 3 is a top plan view of a heel shock attenuating member shown in FIG. 2 in accordance with the present invention.

FIG. 4 is a cross-sectional view of the cantilevered shock attenuating members shown in FIG. 1 taken through line 4—4 of FIG. 1.

DESCRIPTION OF THE PRESENTLY PREFERRED EMBODIMENT

Figure 7:
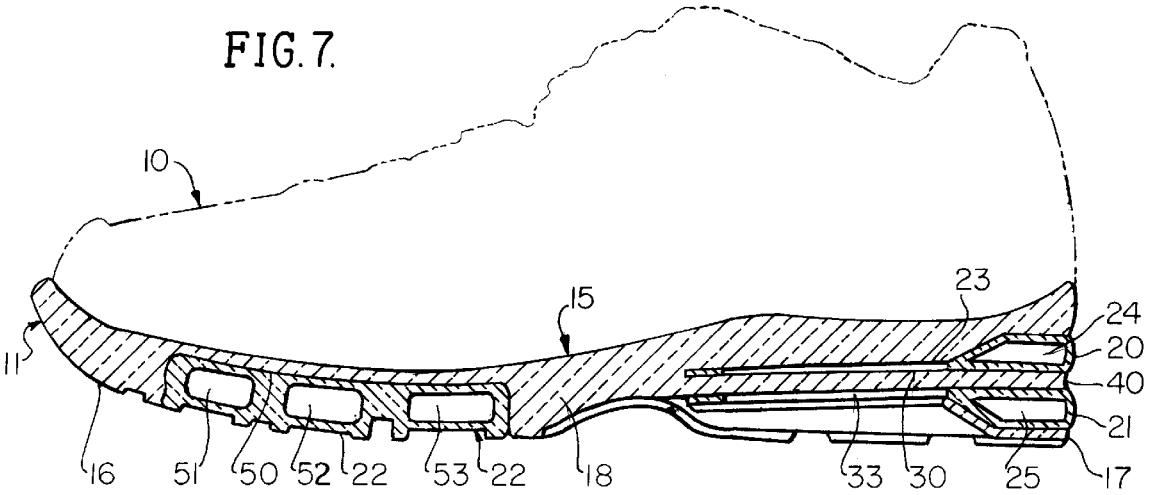
FIG. 7 is a cross-sectional view of the sole assembly shown in FIG. 1 and FIG. 2 taken through line 7—7 of FIG. 2.

The present invention comprises an improved construction for the sole of an athletic shoe as shown in FIG. 1. An upper 10 is joined to a sole 11 at a lasting margin 12. Although the upper 10 illustrated in FIG. 1 is representative of conventional athletic shoes, it is understood the principle of the present invention is applicable to the construction of soles 11 irrespective of the shoe style.

An objective of the present invention is to provide for improved impact response and stability during athletic endeavors such as running, tennis and the like. The present invention shock attenuating members are intended to be incorporated into a sole 11 comprising a midsole 15 and an outsole which is illustrated by the reference numerals 16 and 17. Although outsole 16, 17 is shown to be segmented, it is understood the present invention may be utilized with a unitary outsole.

The upper portion of midsole 15 typically comprises an anatomically shaped middle form 18 typically constructed of ethylene-vinyl acetate copolymer which is generally referred to as EVA. The present invention comprises the use of cantilevered heel shock attenuating members 20 and 21 and a forefoot shock attenuating member 22. As shown in FIG. 7, heel shock attenuating member 20 is secured to midsole form 18 at shaped margin 23. Forefoot shock attenuating member 22 is disposed within a cavity defined by shaped margin 50.

Figure 5:
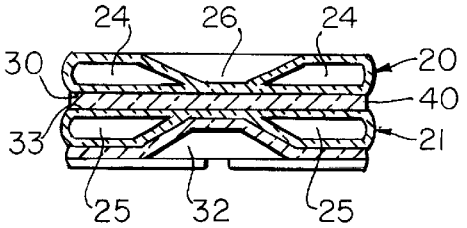
FIG. 5 is a frontal, cross-sectional view of a heel shock attenuating member taken through line 5—5 of FIG. 2.

An understanding of the cantilevered, heel shock attenuating members may be best understood by reference to FIGS. 3, 4 and 5. The heel shock attenuating members 20 and 21 are identical in configuration. As can be seen in FIG. 3, shock attenuating members 20 and 21 are substantially U-shaped in orientation and are adapted to conform to the heel of the shoe. Each shock attenuating member 20 and 21 is constructed of a resilient material impermeable to the passage of fluid and defines enclosed chambers 24 and 25 which are adapted to enclose a pneumatic fluid such as air.

FIG. 3 and FIG. 5 illustrate the structural details of shock attenuating member 20. It is understood the construction of shock attenuating member 21 is identical. The upper surface of shock attenuating member 20 is defined by a peripheral load alignment surface 26 which extends from the rear panel 27 to the front margins 28 and 29. The bottom surface 30 lies in a unitary plane. The rear panel 27 of shock attenuating member 20 extends upwardly from the bottom surface 30 and defines the maximum distance between peripheral load alignment surface 26 and bottom surface 30. As can be best seen in FIG. 4, peripheral load alignment surface 26 is tapered forwardly and downwardly from the upper terminus of rear panel 27 to margin 28. As can also be seen in FIG. 3 and FIG. 4, peripheral load alignment surface 26 is tapered downwardly and inwardly to inner margin 31. In the same manner as described hereinabove, shock attenuating member 21 is identical to shock attenuating member 20 and is defined by a peripheral load alignment surface 32, a bottom surface 33 and rear panel 34.

As described hereinabove, it is an object of the present invention to provide improvement in the impact response of a shoe upon heel contact. This is accomplished through the use of the heel attenuating members 20 and 21 which are incorporated into the shoe through a cantilevered construction best shown in FIG. 7. As shown, the bottom surfaces 30 and 33 of shock attenuating members 20 and 21, respectively, are each secured to the opposing surfaces of a planar foam moderator 40. Heel contact will occur at the rear strike zone of outsole segment 17 thereby compressing the fluid, preferably in the form of air, stored within pneumatic chambers 24 and 25. The forward extension of shock attenuating members 20 and 21 defined by the length of bottom surfaces 30 and 33 will act as a cantilever about the strike zone.

On heel impact, the shoe will tend to bend or flex on a line of flexion which can be considered to be aligned with the longitudinal axis 41 of the shoe. The force imposed on the user's foot will be centered about the longitudinal axis 41 of the shoe as a result of the tapered orientation of peripheral load alignment surfaces 26 and 32. Furthermore, peak loads will be outwardly distributed through the outer extent of the peripheral load alignment surfaces 26 and 32 as the result of the tapered orientation of the peripheral load alignment surfaces 26 and 32 as shown in FIG. 4.

Figure 6:
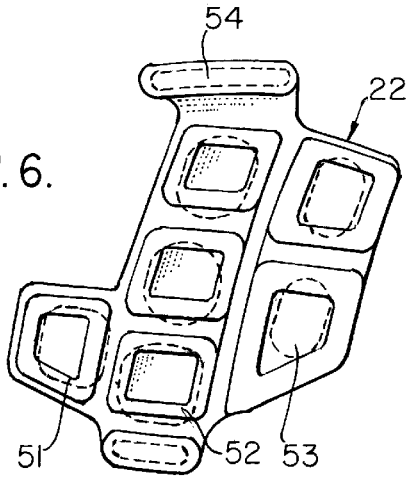
FIG. 6 is a top plan view of the forefoot shock attenuating member shown in FIG. 2.

An objective of the present invention is to provide means for attenuating the forces incident to the impact between the shoe and the ground while concurrently providing stabilization and balance. In furtherance of this objective, forefoot shock attenuating member 22 is disposed within cavity 50 formed in the forefoot of midsole form 18 and outsole segment 16. Forefoot shock attenuating member 22 can be best seen by reference to FIG. 6. Shock attenuating member 22 is substantially planar in configuration and is constructed of a resilient material which is impermeable to the passage of a fluid such as air. An important feature of forefoot shock attenuating member 22 is that it includes a plurality of independent, isolated chambers in both the longitudinal and transverse segments of the forefoot. Longitudinally, the independent chambers are identified by reference numerals 51, 52 and 53. With respect to the longitudinal axis of the shoe, pneumatic chambers 51, 52, 53 and 54 delineate three independent zones. When the strike zone of the shoe moves to the forefoot of the shoe, shock attenuating member 22 will cushion or otherwise attenuate the shock while distributing the force longitudinally and laterally across the full extent of attenuating member 22. This will provide for increased stabilization, durability and improved balance. In the preferred form of the present invention, pneumatic chamber 51 may extend to and be visible at the lateral side of the midsole form 18.

It can therefore be seen the present invention substantially improves upon the variety of sole constructions described in the prior art. With respect to the impact response of heel contact, the cantilevered construction of shock attenuating members 20 and 21 create an extended lever arm along bottom surfaces 30 and 33 at the rear of the shoe. This will result in centering the loads imposed upon the heel of the shoe and distribute peak loads to the periphery of the attenuating members 20 and 21. Upon forefoot contact, shock attenuating member 22 provides improved cushioning on impact and thereby stabilizes the user's foot.

I claim:

1. A shoe sole comprising:

(a) a midsole having a heel segment and a forefoot segment and a line of flexion extending from the heel segment to the forefoot segment, the rear segment defining a rear strike zone;

(b) a forefoot shock attenuating member having at least three resilient pneumatic chambers extending along the line of flexion and coupled to the midsole at the forefoot segment; and (c) first and second heel shock attenuating members each including a pneumatic chamber tapered downwardly and forwardly from the rear strike zone of said heel segment along the line of flexion, each comprising a substantially U-shaped chamber having a rear panel and frontal margins and an inner margin and a load alignment surface opposed to a bottom surface being tapered forwardly and downwardly from said rear panel to said frontal margin, said first and second heel shock attenuating members being coupled to the heel segment of said midsole; and (d) a planar foam moderator having upper and lower surfaces, the bottom surfaces of said first and second heel shock attenuating members being secured to the top and bottom surfaces of said foam moderator respectively.

2. A shoe sole as defined in claim 1 wherein said load alignment surface tapers downwardly and inwardly from the periphery to the inner margin.

3. A shoe sole as defined in claim 1 wherein said first and second heel shock attenuating members concurrently cantilever about the rear strike zone.

4. A shoe sole as defined in claim 1 wherein said line of flexion extends along a longitudinal axis of the midsole.

5. A shoe sole as defined in claim 1 wherein the pneumatic chambers of said forefoot shock attenuating member are isolated from one another.

6. A shoe sole as defined in claim 1 wherein the pneumatic chambers of said first and second heel shock attenuating members are isolated from one another.

7. A shoe sole comprising:

(a) a midsole having a heel segment and a forefoot segment and a line of flexion extending along the longitudinal axis of the midsole from the heel segment to the forefoot segment, the rear segment defining a rear strike zone;

(b) a forefoot shock attenuating member having at least three, isolated pneumatic chambers adapted for maintaining fluid therein extending along the line of flexion and coupled to the midsole at the forefoot segment;

(c) first and second shock attenuating members each including isolated pneumatic chambers adapted for maintaining fluid therein tapered downwardly and forwardly from the rear strike zone of said heel segment along the line of flexion, each comprising a substantially U-shaped chamber having a rear panel and frontal margins and an inner margin and a load alignment surface opposed to the bottom surfaced being tapered forwardly and downwardly from said rear panel to said frontal margin; and (d) a planar foam moderator having upper and lower surfaces, the bottom surfaces of said first and second heel shock attenuating members being secured to the top and bottom surfaces of said foam moderator respectively.

8. A shoe sole as defined in claim 7 wherein said first and second heel shock attenuating members concurrently cantilever about the rear strike zone.

* * * * *